US005533234A

United States Patent [19]

Bizek

[11] Patent Number: 5,533,234

[45] Date of Patent: Jul. 9, 1996

[54] TORSION HINGE WITH TUBULAR PIVOT PIN

[75] Inventor: Donald R. Bizek, Woodridge, Ill.

[73] Assignee: Stocker Hinge Manufacturing Company, Brookfield, Ill.

[21] Appl. No.: 332,070

[22] Filed: Nov. 1, 1994

[51] Int. Cl.[6] ..... E05F 1/10

[52] U.S. Cl. ..... 16/308; 16/277; 49/386

[58] Field of Search ..... 49/366, 367, 379, 49/386; 16/277, 278, 257, 280, 308, 335, 386

[56] References Cited

U.S. PATENT DOCUMENTS

| | | | |
|---|---|---|---|
| 1,827,365 | 10/1931 | Keene | 16/280 |
| 3,255,484 | 6/1966 | MacDonald | 16/278 |
| 3,262,149 | 7/1966 | Gorton et al. | 16/278 |
| 3,550,187 | 12/1970 | Swartz | 16/278 |
| 3,600,743 | 8/1971 | Meadows | 16/278 |
| 3,695,678 | 10/1972 | Gergoe | 16/308 |
| 3,950,818 | 4/1976 | Holmes | 16/296 |
| 4,389,748 | 6/1983 | Grossman | 16/278 |
| 4,785,501 | 11/1988 | Obana | 16/308 |
| 4,850,081 | 7/1989 | Grant | 16/257 |
| 5,373,665 | 12/1994 | Lyons, Sr. | 49/386 |

FOREIGN PATENT DOCUMENTS

| | | | |
|---|---|---|---|
| 318969 | 6/1989 | European Pat. Off. | 16/308 |
| 2556059 | 7/1976 | Germany | 16/308 |
| 1547 | 7/1854 | United Kingdom | 16/308 |
| 645561 | 11/1950 | United Kingdom | 16/308 |

*Primary Examiner*—W. Donald Bray
*Attorney, Agent, or Firm*—Keil & Weinkauf

[57] ABSTRACT

A hinge is provided with a tubular hinge pin. This allows the use of a torsion rod, inserted through the tubular hinge pin, of any desired diameter smaller than that of the interior of the hinge pin, thereby permitting easy adaptation of the resistance provided by the torque rod.

9 Claims, 2 Drawing Sheets

TORSION HINGE WITH TUBULAR PIVOT PIN

BACKGROUND OF THE INVENTION

This invention deals with a hinge with a torsion rod inserted through its knuckles, attached to or restrained by one leaf or an adjacent component at its one end, and the other leaf or adjacent component at its other. Such torsion rod hinges are well known in the art, with the torsion rod acting as the pivot pin itself. This dual function has, however, limited the flexibility of these applications, as the necessity that the torque rod mate with the knuckles negates the possibility of lessening the torque effect by diminishing the rod's diameter.

SUMMARY OF THE INVENTION

This disadvantage of dual-function torque rods is overcome with the instant invention. Its distinguishing feature is that it incorporates a tubular pivot pin, through which the torque rod fits. Since the snug-fitting tubular pivot pin handles the task of serving as a pivot for the hinge, the torque rod need not be of any particular diameter, but rather can be of any diameter up to the inside diameter of the tubular pivot pin, and can thus be sized to provide the desired torque effect.

BRIEF DESCRIPTION OF THE DRAWINGS

The invention is easily grasped by viewing the drawings, where.

DETAILED DESCRIPTION OF THE PREFERRED EMBODIMENT

A hinge with two leaves (1, 2), having knuckles (3, 4) encircling a tubular pivot pin (5). A torque rod (7), longer than the knuckle area, is inserted through the hollow center of the pivot pin, with the excess length of the torque rod extending out both ends of the pivot pin. The ends of the torque rod sticking out of the ends of the pivot pin are each bent to contact a hinge leaf or adjacent component, as shown in FIGS. 3 and 4, and at angles relative to each other according to whether the torque rod is supposed to urge the hinge into the open or closed position, and to what extent it is to do so.

Figure 1:
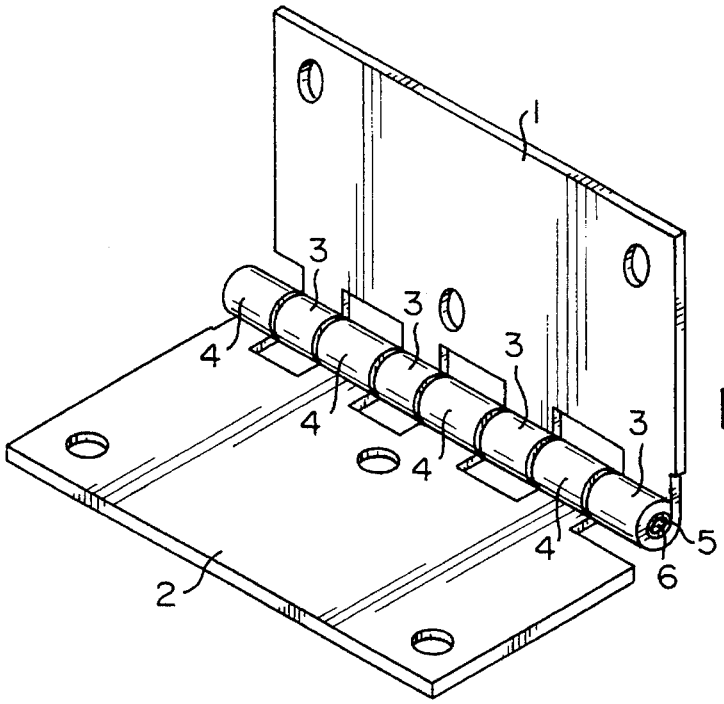
FIG. 1 shows a hinge with a tubular pivot pin (5)
Figure 2:
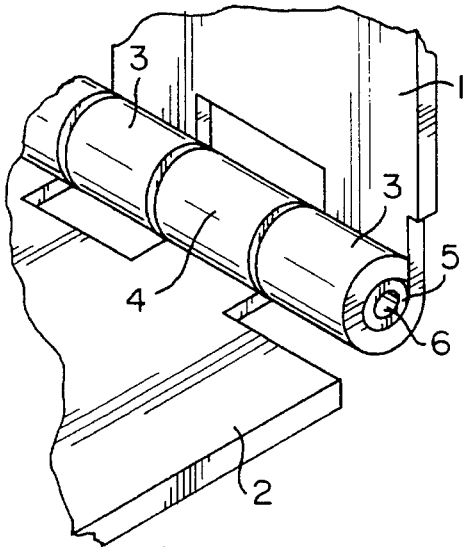
FIG. 2 is an enlarged view of the area where the pivot pin (5) enters the knuckles (3, 4)
Figure 3:
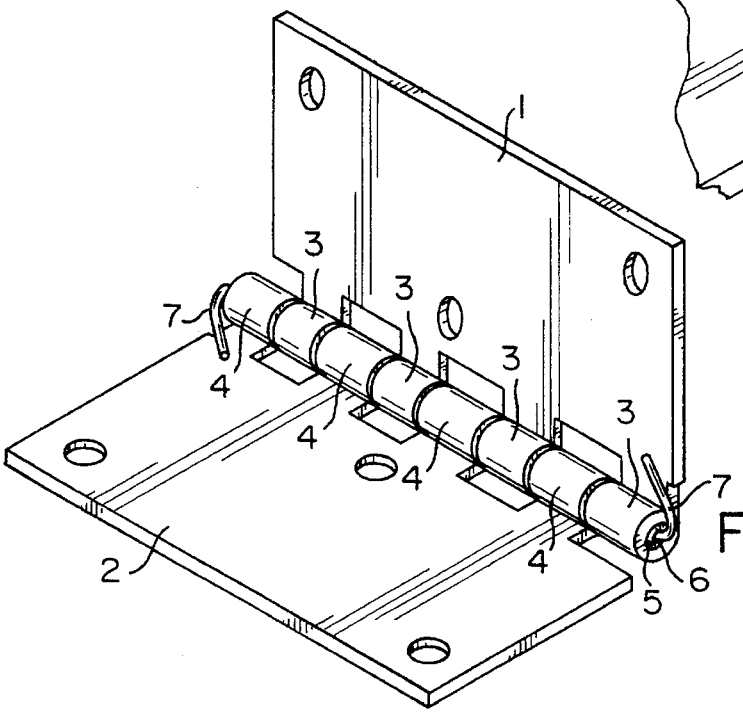
FIG. 3 shows a hinge with a tubular pivot pin (5), with a torque rod (7) inserted through the hollow center (6) of the pivot pin, and the ends of the torque rod restrained by the leaves (1, 2).
Figure 4:
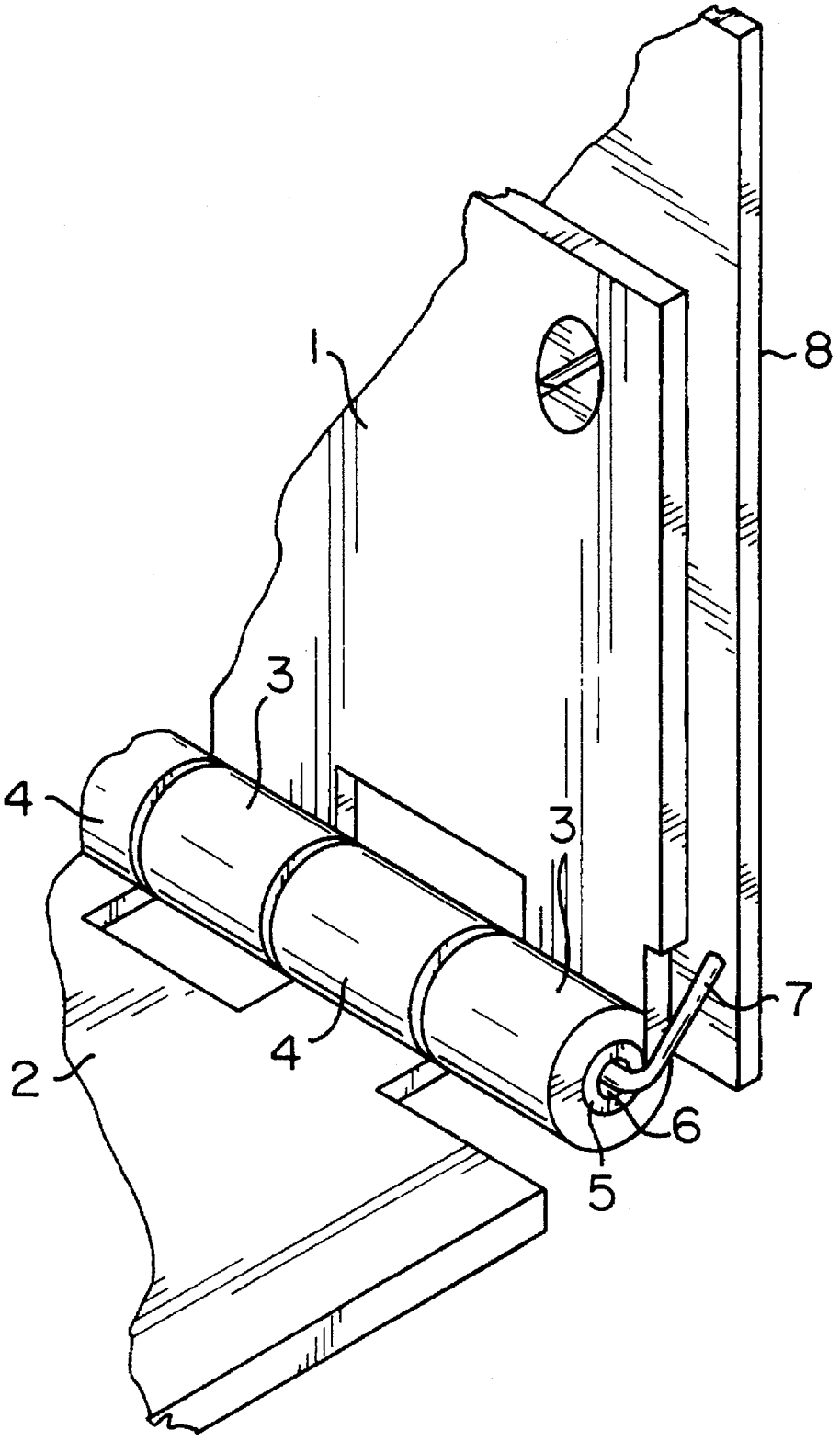
FIG. 4 shows a partial view of a hinge as in FIG. 3, save with the end of the torque rod (7) being restrained by an adjacent component (8).

For example, as depicted in FIG. 3, the torque rod ends are bent at a roughly 90° angle relative to each other, with the end on the right serving to hold the right-hand leaf in the upright position, and the end on the left holding the left-hand leaf in the horizontal position. An attempt to push the two leaves together from the depicted position would twist the torque rod, which would in turn resist that motion and tend to return the leaves to their depicted position.

It is easy to see that the ends of the torque rod can just as easily be bent over "outside" the leaves or adjacent component, so as to resist an opening rather than a closing motion, or that the ends of the torque rod could be fastened to one leaf or adjacent component each, so as to resist both an opening and a closing motion, as with a swinging door.

It is further evident that the depicted bending over of the torque rod ends is by no means the only way envisioned for having the torque rod acted upon by the movement of the hinge leaves, and this invention is not intended to be limited to only that embodiment. Likewise, the composition of the leaves, tube and rod can vary widely, and is not intended to be restricted to a particular material or materials.

We claim:

1. A hinge having two or more leaves and a tubular pivot pin, in which one or more torque rods, each having two ends, fit through the tubular pivot pin, with one end of each torque rod being restrained by one leaf or an adjacent component, and the other end of each torque rod being restrained by another leaf or adjacent component.

2. A hinge according to claim 1, having two leaves and one torque rod, wherein the ends of the torque rod extend beyond the ends of the pivot pin and are bent to contact the hinge leaf or adjacent component.

3. A hinge according to claim 2, wherein the ends of the torque rod are bent so as to resist closing of the hinge.

4. A hinge according to claim 2, wherein the ends of the torque rod are bent so as to resist opening of the hinge.

5. A hinge having two or more leaves and a tubular pivot pin, in which one or more torque rods, each having two ends, fit through the tubular pivot pin, with one end of each torque rod being attached to one leaf or an adjacent component, and the other end of each torque rod being attached to another leaf or adjacent component.

6. A hinge according to claim 5, having two leaves and one torque rod, wherein the ends of the torque rod extend beyond the ends of the pivot pin and are bent to contact the hinge leaf or adjacent component.

7. A hinge according to claim 6 wherein the ends of the torque rod are bent so as to resist closing of the hinge.

8. A hinge according to claim 6 wherein the ends of the torque rod are bent so as to resist opening of the hinge.

9. A hinge according to claim 6, wherein the ends of the torque rod are attached to the hinge leaves or adjacent components so as to resist both the opening and closing of the hinge.

* * * * *